US007093961B2

(12) United States Patent
Bentley et al.

(10) Patent No.: US 7,093,961 B2
(45) Date of Patent: Aug. 22, 2006

(54) LANTERN WITH IMITATION FLAME SOURCE

(75) Inventors: Roger D. Bentley, Coloma, MI (US); Bradford B. Jensen, Saint Joseph, MI (US); Kim I. McCavit, Saint Joseph, MI (US)

(73) Assignee: Jenesis International, Inc., Stevensville, MI (US)

( * ) Notice: Subject to any disclaimer, the term of this patent is extended or adjusted under 35 U.S.C. 154(b) by 120 days.

(21) Appl. No.: 10/844,075

(22) Filed: May 12, 2004

(65) Prior Publication Data

US 2005/0254232 A1 Nov. 17, 2005

(51) Int. Cl.
*F21V 11/00* (2006.01)

(52) U.S. Cl. ..... 362/355; 362/240; 362/359; 362/555; 362/569; 362/576

(58) Field of Classification Search ..... 362/161, 362/190, 351, 392, 800, 810, 240, 355, 359, 362/555, 569, 576
See application file for complete search history.

(56) References Cited

U.S. PATENT DOCUMENTS

| | | | | |
|---|---|---|---|---|
| 3,983,384 | A * | 9/1976 | Bucci | 362/229 |
| 5,097,180 | A * | 3/1992 | Ignon et al. | 315/200 A |
| 5,262,929 | A * | 11/1993 | Lenhart | 362/161 |
| 6,616,308 | B1 | 9/2003 | Jensen et al. | |
| 2002/0070633 | A1 * | 6/2002 | Salender et al. | 310/306 |
| 2003/0035291 | A1 * | 2/2003 | Jensen et al. | 362/351 |
| 2003/0210555 | A1 * | 11/2003 | Cicero et al. | 362/555 |
| 2004/0037069 | A1 * | 2/2004 | Blackbourn | 362/161 |

FOREIGN PATENT DOCUMENTS

WO WO 03/016783 A1 2/2003

* cited by examiner

*Primary Examiner*—Stephen F. Husar
*Assistant Examiner*—Meghan K. Dunwiddie
(74) *Attorney, Agent, or Firm*—O'Malley and Firestone

(57) ABSTRACT

A decorative lantern evocative of enclosing a candle or other open flame type light source includes an imitation candle and a super bright light emitting diode hidden with the lantern to illuminate the imitation candle from outside. A wick having a polished tip produces a hot spot of reflected light to heighten the illusion of an open flame being present.

18 Claims, 4 Drawing Sheets

LANTERN WITH IMITATION FLAME SOURCE

BACKGROUND OF THE INVENTION

1. Technical Field

The invention relates to decorative lighting and more particularly to a lantern housing an electrically powered imitation flame source.

2. Description of the Problem

Many people find candle and gas light pleasant. The flickering of light and movement of shadows across nearby surfaces generated by an open, flickering flame can be almost hypnotically soothing. As a result, candles have remained popular for generations since the invention of more practical electrical lighting, especially for decorative and mood setting purposes. This has remained so notwithstanding the hazard posed by open flames, the short service life of candles and the expense of supplying gas to exterior lamps.

Numerous electrically powered lamps have been proposed in the art intended to produce an impression of an open flame. Some lamps have included bulbs with plates producing irregular, low level electrical arcing while other lamps have been shaped as candles and topped with flame shaped bulbs. Producing an impression of realism however requires an appreciation of the conditions under which the device is used and the likely distances at which it is commonly viewed. Where the device is intended to resemble a candle a number of factors should be considered. These include the color of the light and the intensity of the light. The way in which the body of the candle picks up and scatters light can be critical to producing an impression of a flame.

In U.S. Pat. No. 6,616,308 the inventors of the present application proposed an imitation candle incorporating a super bright, light emitting diode (LED). Super bright LEDs function as highly directional, near point sources. An emission color, such as amber, is selected for the LED to produce a light similar in color to that of a paraffin fed flame. A simple circuit using multiple oscillators running at close, but not the same, frequencies, creates a realistic, pseudo-random flicker for light emitted by the LED.

The body of the imitation candle of the '308 patent is preferably a translucent material. The translucent material surrounds the LED on the sides and top and serves to diffuse the light throughout the portion of the imitation candle at or above the height of the LED. The LED is positioned near the top of the body and causes the top of the imitation candle to be more brightly illuminated than the lower parts of the candlestick. This effect can be enhanced by positioning an opaque light block around the base of the LED to prevent diffusion of light into the lower portions of the imitation candle. These steps simulate the usual diffusion of light in a real candle. Recessing the top within the side walls presents the appearance of a candle that has already been burning for some length of time, which would serve to hide the flame behind an unmelted rim, were a flame present. The body of the imitation candle is preferably made from real wax to further enhance the imitation candle's realism.

The power consumption of super bright LEDs operated at low emission levels is low enough that long battery life can be achieved. Alternatively, rechargeable cells can be used in conjunction with a solar cell or other recharging means. A simple light sensing device can be used to turn the LED off during daylight hours and extend battery life in battery operated versions of the candle.

While the imitation candle taught in the '308 patent has been highly successful, different considerations come into play in producing a lantern intended to be electrically illuminated, but none-the-less giving the impression of having a flame source. Lanterns are often intended to serve both functional and decorative purposes. They tend to be seen from greater distances and provide an enclosure for the light source. These factors suggest that straight application of an imitation candle to a lantern, while potentially satisfactory, may be improved upon.

SUMMARY OF THE INVENTION

According to the invention there is provided a decorative lantern suitable for outdoor use having a housing with a base, a globe rising vertically from the base and a cap covering the globe. The lantern includes an artificial light source which may be energized to luminesce in a flickering fashion in the manner of the wind blown candle fed flame. A translucent, light scattering body is positioned on the base of the housing enclosed within the globe. Extending upwardly from the light scattering body is an imitation wick. The tip of the imitation wick is polished, preferably to a near mirror like finish so that it reflects light without scattering or diffusing the light. A super bright light emitting diode is located above the vertical extent of the globe under and within the cap, and is oriented to project light downwardly toward the upper surface of the translucent, light scattering body and the imitation wick. An energization circuit is providing for causing the super bright light emitting diode to luminesce. A second super bright light emitting diode may be positioned within the translucent, light scattering body.

Additional effects, features and advantages will be apparent in the written description that follows.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
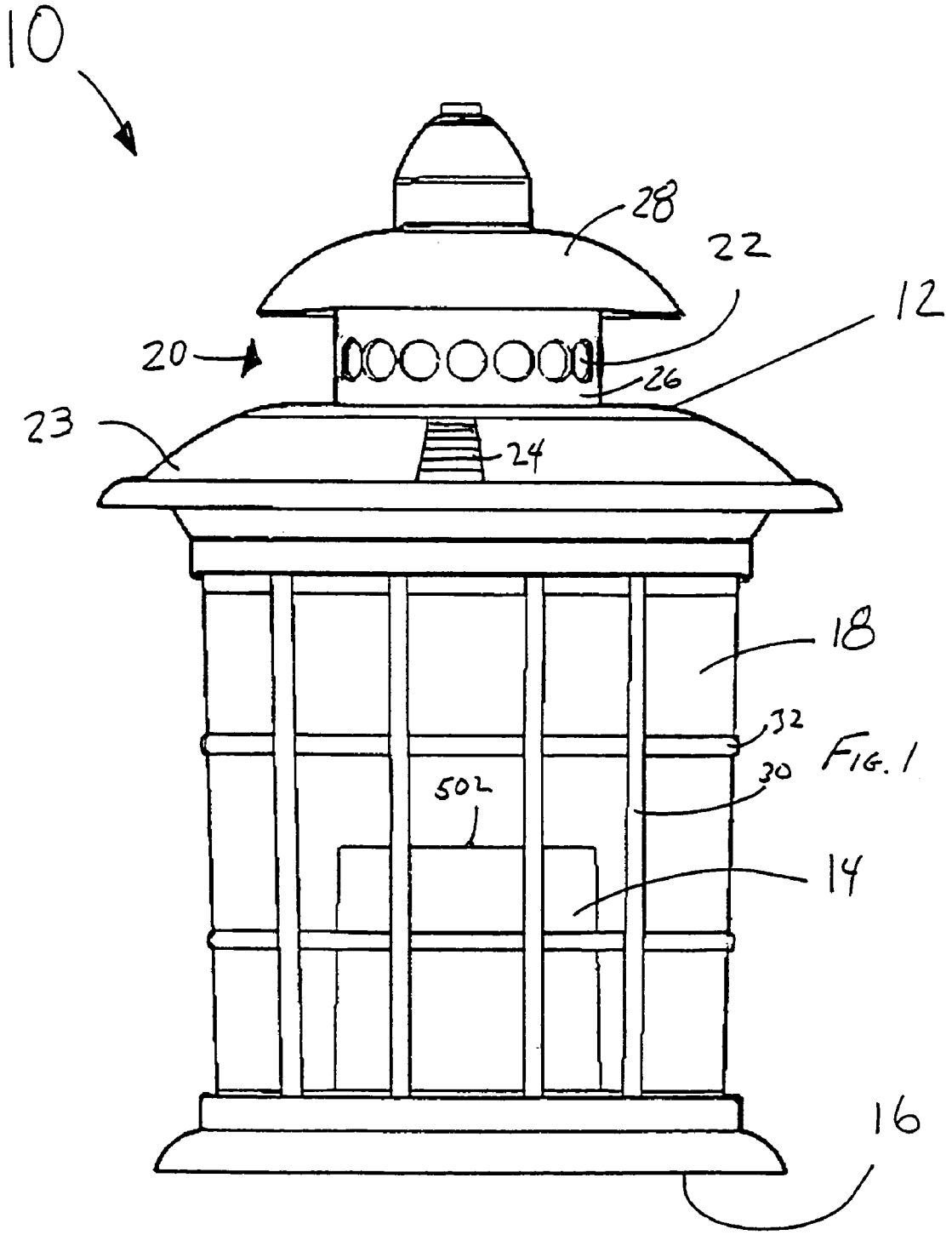
FIG. 1 is a front elevation of a exterior lamp constructed in accordance with one embodiment of the invention.

Referring now to the figures and in particular to FIG. 1, a lantern 10 is illustrated comprising a housing 12 for a light source and a light scattering body 14. Light scattering body 14 is supported on a floor or base 16 to housing 12. Light scattering body 14 is configured to resemble a broad stem or block candle. The globe 18 of housing 12 is constructed of glass or other transparent material, is formed as a cylinder and surrounds light scattering body 14. Globe 18 being transparent, it allows light scattering body 14 to be seen from the side of lantern 10. The cap 20 of housing 12 is a peaked roof like structure having a lower, outer cap 23, a central vertical cylinder 26, which is decorated with simulated ventilation holes 22 which give the lamp or lantern housing the appearance of a lamp or lantern which can support an open flame, and an upper or inner cap 28. Cap 20 encloses a sufficient volume to house a light source and a light source energization circuit, as described below. A solar actuated switch 24 may be disposed on outer cap 23. Globe 18 is enclosed in a grating or guard comprised of vertical rods 30 and hoops 32.

Figure 2:
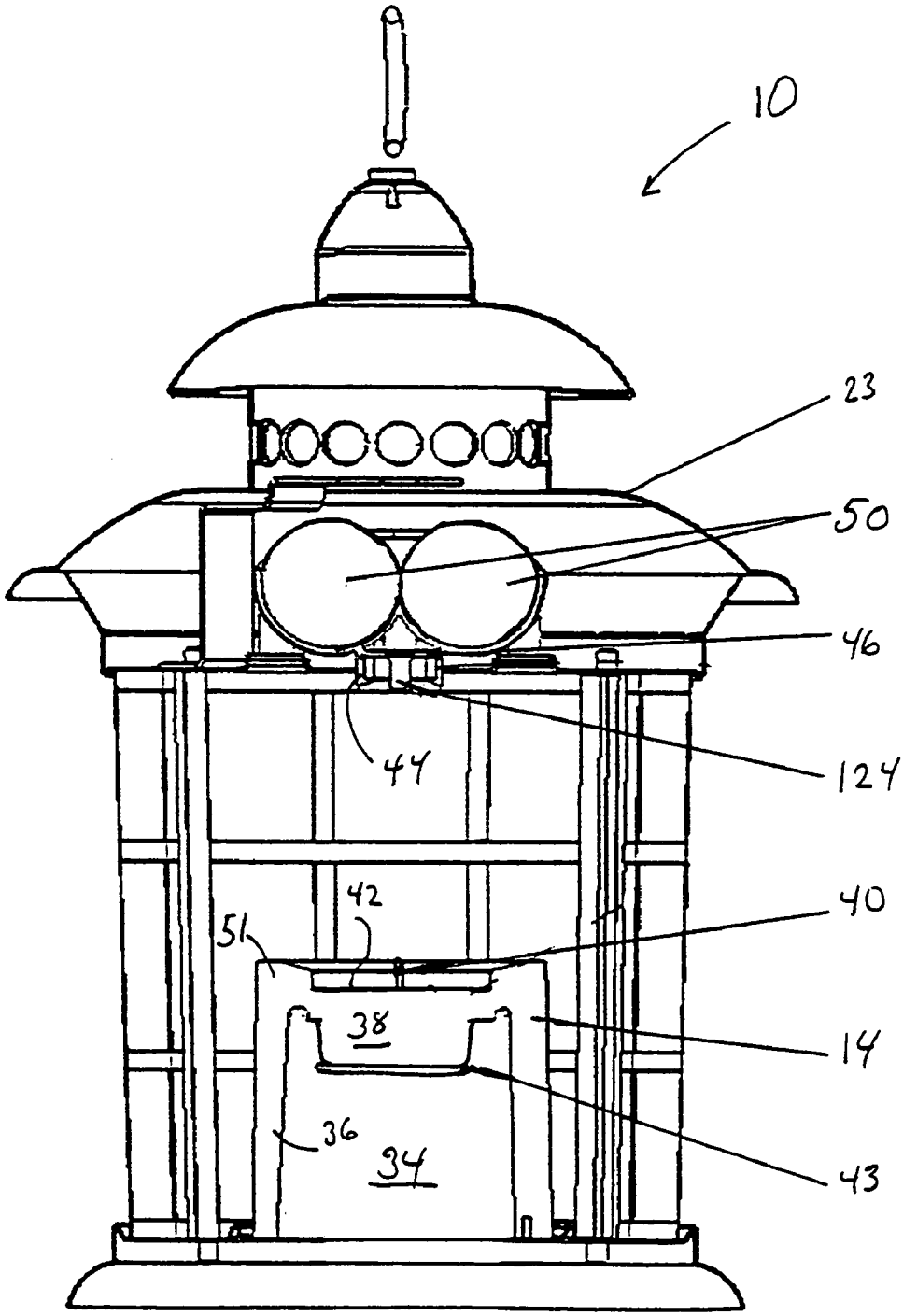
FIG. 2 is a partial cutaway view of an exterior lamp constructed in accordance with one embodiment of the invention.

Referring now to FIG. 2, a partial cross-section or cutaway view of lantern 10 illustrates a preferred disposition of the illumination source, a super bright amber LED 124. LED 124 is located horizontally centered within and near the bottom of outer cap 23, preferably just high enough within the cap not to be readily visible from outside of lantern 10. LED 124 is located downwardly oriented so that most light from the LED is directed toward base 16 and the upper surface of light scattering element 14. LED 124 is positioned in a light shield 44 which is open toward the bottom. LED 124 is energized from an energization circuit 46 which is turn powered by batteries 50, all of which are tucked into outer cap 23. LED 124 is thus located at a location spaced from the light scattering body 14 which it illuminates. As used herein the term scattering is intended to mean the process whereby light transmitted or reflected by the medium becomes diffuse. The preferred embodiment is illustrated using one LED and is used as a battery powered, wireless device. However, If line power is available, a plurality of LEDs may be positioned above the light scattering body 14 if desired to produce more light, or a plurality of LEDs may be used to good effect in a larger lamp.

Light emitted from LED 124 is directed toward light scattering body 14, which is shaped to resemble a block candle. The central axis of light emitted from LED 124 impinges the center of the horizontal upper surface of the light scattering body 14. This surface has a central depression 42 and a wick 40, rising toward the LED 124 from the center of the central depression. As described below, wick 40 has a polished end or tip 502 distal to central depression 42 which reflects light impinging thereon substantially without scattering, to produce high intensity points of light visible to viewers from outside of lantern 10. Light scattering body 14 has a cylindrical sidewall 36 and an upper surface including a depressed central region 42. A light scattering block 38 is disposed under depressed central region 42. Light impinging on light scattering body 14 is intended to diffuse in block 38, producing a glowing region evocative of illumination from a flame partially or fully obscured by the rim 51 surrounding the depressed central region 42. An opaque shield is disposed across the bottom of block 38 preventing transmittal of light into the hollow interior 34 of the light scattering body 14.

Light scattering body 14 is a cylindrical body molded from conventional temperature and weather resistant plastics for outdoor use and resembling an overturned cup. The material used to fabricate light scattering body should be translucent, having light transmission and diffusing characteristics similar to candle wax. Hollow interior 34 reduces in quantity the amount of material required to construct the body.

Figure 3:
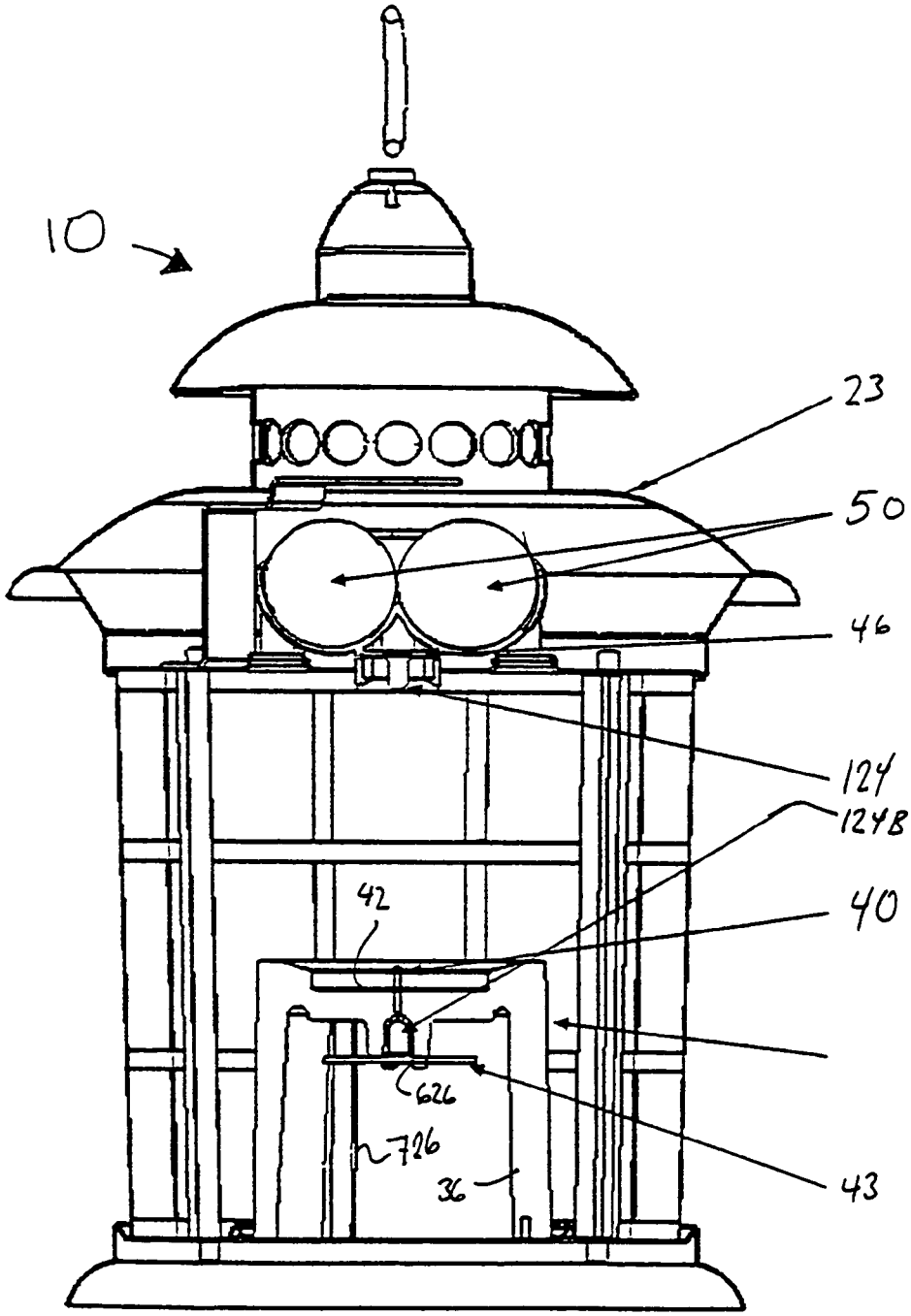
FIG. 3 is a partial cutaway view of an exterior lamp constructed in accordance with a second embodiment of the invention.

Now referring to FIG. 3 a light source 124 preferably emits highly directional light from a small area. This is advantageously achieved by using a super bright light emitting diode (LED) oriented to transmit most of its light downwardly toward the depressed central region 42. A second light source 124B may be used if lantern 10 is so large as to render a single overhead tight source 124 inadequate. A second light source body 124B is placed in a cavity 626 just below the surface formed by depressed central region 42 as taught in U.S. Pat. No. 6,616,308, assigned to the assignee of the present patent. LED 124B is located in a cavity extending upwardly from hollow interior 34. Cavity 626 is preferably sized to be just slightly larger than LED 124B with the LED nested upright therein.

The light intensity on cylindrical vertical side wall 18 of body 12 will be roughly proportional to the square of the distance between the light source body/LED 124B and the surface. The thickness of material directly above the light source body 24 can be selected to generate a 'hot spot' of fairly intense light that is similar in size to the diameter of a real candle's flame. Generally though, light source body 24 is positioned so as not to be conveniently directly viewable from outside of body 12. In other words, optically diffusing material is preferably interposed between a casual viewer and LED 124B in directions to the side and above the light source body. Propagation of light downwardly from LED 124B is preferably blocked by an opaque disk 43 positioned at the base of the LED.

LED 124B is connected by wires 726 to circuit board 46 to flicker at the same rate as the primary LED 124 still located within outer cap 23. Circuit board 46 preferably mounts a flicker circuit (described below) to cause the LED 124B to vary in brightness in a pseudo-random manner to simulate the flickering of a real candle flame. Yet another option is to provide a solar cell that charges one or more rechargeable batteries.

Light emitted from LEDs 124 and 124B should be highly directional and close to being a point source to achieve the best results. The outer, light transmitting surface of the LEDs is cylindrically shaped, terminating at one end in a hemisphere. The LEDs are capped at their lower ends in an opaque base with the result being that most of the light emitted is directed out the LED's hemispherical ends, with some light escaping to the sides.

Figure 4:
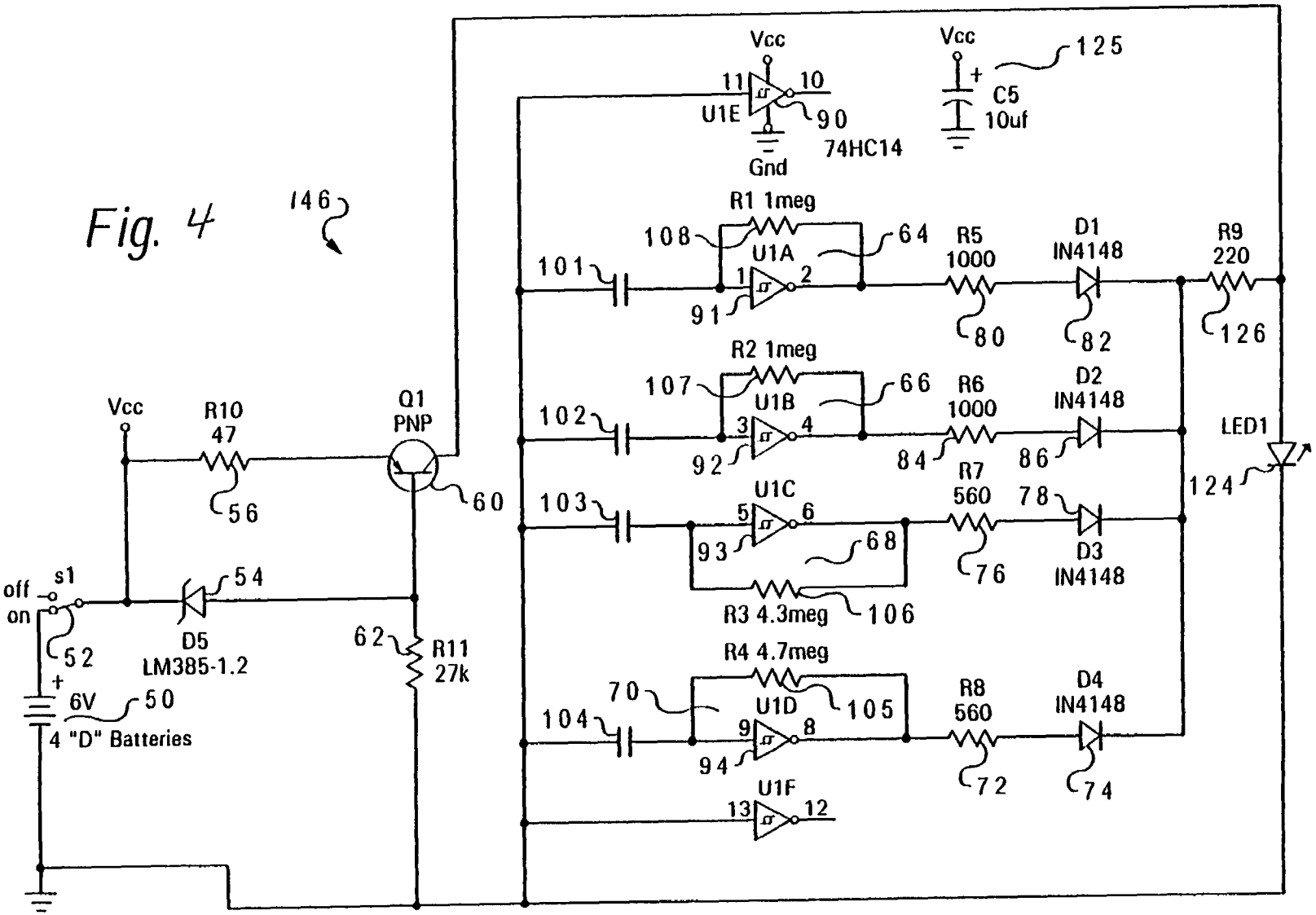
FIG. 4 is a detailed circuit schematic for a flicker energization circuit for either embodiment of the invention.

FIG. 4 illustrates representative energization electronics 146 for driving LED 124 and LED 124B, if provided. A battery 50 is provided by two size D cells. Different power sources can be used depending upon desired battery life or the desired brightness to be obtained from the LED. As mentioned above, alternatives include combinations of solar cells and rechargeable cells or an outside line source of power. LEDs 124 and 124B are preferably the Global Opto G-L202YTT-T amber light emitting diode package. Energization electronics may be switched on and off using a switch 52 which is attached at one pole to the positive terminal of battery 50. Switch 52 may be a photosensitive device, such a photosensitive transistor. Battery 50 also supplies $V_{cc}$ within LED energization electronics 146.

LEDs have a constant voltage drop when conducting current and the intensity of light emission from an LED is controlled by varying the current sourced to the LED. Accordingly, the LED energization circuit 146 sources a varying amount of current to LED 124 (or 124B) to produce a flickering effect. The first major element of energization circuit 146 is a base current source provided by zener diode 54, resistors 56 and 62, and a PNP transistor 60, which sources current to the load, here a light emitting diode 124. The voltage source provided by battery 50 is connected to the transistor 60 emitter by resistor 56 and to base of the transistor by reverse oriented zener diode 54. The transistor is assured of being constantly biased on by the voltage drop set by the reverse breakdown voltage of zener diode 54 as long as battery voltage remains the minimum required for zener breakdown operation. Thus transistor 60 sources current to the load through which the current returns to ground. As a result LED 124 always produces a minimum level of light output when the device is on and the battery has a minimum charge.

Variation in light output is effected by variably increasing the current supplied to LED 124. A hex inverter, such as a SN74HC14N hex inverter, available from Texas Instruments of Dallas, Tex., is used to implement several parallel oscillators or clocks. All of the oscillators are identically constructed though external component values may be altered. In the preferred embodiment 4 of 6 available invertors (91–94) are used with resistors (105–108) providing feedback from the outputs of the invertors to the inputs. Capacitors 101–104 are connected from the inputs of invertors 91–94 to set the operating frequency of the oscillators. The connection of $V_{cc}$ to the invertors is represented for inverter 90 (U1E) only but is identical for each of invertors 91–94.

Oscillators 68 and 70 are designed to be low frequency oscillators running at approximately 2 Hz. Oscillators 68 and 70, formed using invertors 94 and 93, can use similar timing components to run at approximately a 10% difference in frequency. The 10% difference in frequency prevents oscillators 68 and 70 from synchronizing with each other or from drifting past one another too slowly. Low frequency oscillators 68 and 70 provide current to the LED 124 through series connected resistors and forward biased diodes 76 and 78, and 72 and 74, respectively, to a summing junction. As a result, current flow through LED 124 is increased from the minimum set by the current source formed by PNP transistor 60 pseudo-randomly. When either of oscillators 68 or 70 is high, it supplies extra current to LED 124 and the LED becomes slightly brighter. When both of oscillators 68 and 70 are high, a third, higher level of current is supplied to the LED 124. The three current levels (both high, only one high, or both low) provide three brightness levels that can be selected by the choice of values for resistors 76 and 72 and the current from the current source. As long as the two oscillators are not synchronized, the three brightness levels will vary in a pseudo-random manner as the oscillators drift. Loose component tolerances are acceptable as contributing to the degree of randomness in current sourced to LED 124.

In some applications oscillators 68 and 70 may be set to have as great as a 2:1 variation in frequency. The rate at which the oscillators drift past one another is consequential to the appearance of the luminary.

In the preferred embodiment oscillator 66, formed using inverter 92, operates at about 8 Hz. and provides two more current levels. Three parallel current sources allow for a total of six brightness levels. Again the output from the inverter is fed through a series connected resistor 84 and forward biased diode 86 to a summing junction and then by resistor 126 to LED 124. The value chosen for resistor 84 is higher than for resistors 78 and 74 with the result that oscillator 66 makes a smaller current contribution to LED 124 than oscillators 68 and 70. This contributes still more to the impression of randomness in the light output of LED 124 by providing that changes in light output occur in differing sized steps. Oscillator 64, formed using inverter 91, is also set to run at about 8 Hz. The resistance of resistor 80 is comparable to that of resistor 84 so that oscillator 64 contributes a current comparable to the current supplied by oscillator 66. The current from inverter 91 is routed to LED 124 by resistor 80 and diode 82 to the summing junction and than by resistor 126. A capacitor 125 may be connected between $V_{cc}$ and ground to short circuit noise to ground preventing circuit noise from causing the oscillators to synchronize with one another.

As shown, two of the gates of the hex inverter are not used, but these gates could be used to create two more oscillators with outputs driving additional candles using multiple LEDs or supplying additional current levels to a single LED. Switch 52 is illustrated as a mechanical switch, however a photosensitive element may readily be substituted so that the lantern turns off automatically in daylight.

Figure 5:
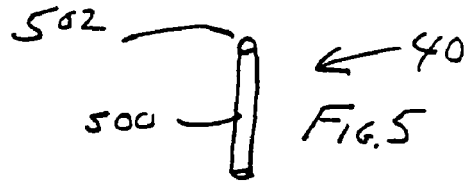
FIG. 5 is a perspective view of an imitation wick used to implement the invention.

FIG. 5 illustrates a wick 40 having a light scattering or blackened central stem 500 and a reflecting Up 502. Tip 502 may be hemispherical or faceted to reflect light without optical scattering. Tip 502 may be positioned to extend just above rim 51 of light scattering body 14 to catch some of the light projected thereon from LED 124 and produce a visible hot spot to catch the eye of a viewer. Tip 502 may be polished metal to minimize scattering of incident light from LED 124 on reflection. This is intended to produce a bright flickering spot of light which to a viewer may resemble a glowing end of a wick or the tip of a largely obscured flame burning on top of light scattering body 14.

The invention provides a lantern suitable for both functional and decorative purposes. The scattered light from the upper part of the imitation candle maintains the illusion of an open flame while the unscattered light reflected by the tip of the imitation wick allows the lantern to be seen from a greater distance, improving the functionality of the lantern as a marker. Projection of the light into the candle body from a hidden source positioned above the body is particularly effective in effecting an appearance of light from a candle flame scattered by the walls of a candle body.

While the invention is shown in only two of its forms, it is not thus limited but is susceptible to various changes and modifications without departing from the spirit and scope of the invention.

What is claimed is:

1. A lantern comprising:

a housing having a base and a cap located spaced from the base;

a light scattering, translucent body supported within the housing on the base between the base and the cap to be substantially fully visible between the base and the cap and shaped and sized to appear to be a candle, the light scattering, translucent body having an upper surface, with the upper surface of the light scattering, translucent body at a spaced location relative to and under the cap; and a first light source located within the cap where it is spaced from the light scattering, translucent body and substantially hidden from view to an observer by the cap, and with the first light source and the light scattering body being mutually oriented so that light emitted from the first light source illuminates the light scattering, translucent body from its upper surface inwardly to produce a diffuse glow from within a region of the light scattering, translucent body.

2. A lantern as set forth in claim 1, further comprising:

a wick extending upwardly from the upper surface of the light scattering, translucent body, the wick having a non-diffusing light reflecting tip distal to its base at the upper surface, the non-diffusing light reflecting tip and the first light source being mutually positioned to allow the non-diffusing light reflecting tip to catch and reflect light projected from the first light source.

3. A lantern as set forth in claim 2, further comprising:

the upper surface of the light scattering, translucent body having a central depression, the wick extending upwardly from the central depression with the non-diffusing light reflecting tip extending above a rim of the light scattering, translucent body defining horizontal limits to the central depression.

4. A lantern as set forth in claim 1, further comprising:

a central depression in the upper surface of the light scattering, translucent body; and the light source being located within the cap and oriented to emit light generally downwardly onto the central depression of the light scattering, translucent body.

5. A lantern as set forth in claim 1, further comprising:

an energization circuit connected to the light source causing the light source to emit light in a flickering manner.

6. A lantern as set forth in claim 1, further comprising:

a second light source located within the light scattering, translucent body below the upper surface of the light scattering, translucent body; and a flicker energization circuit connected to energize the light source and the second light source.

7. A lantern as set forth in claim 5, further comprising:

a central depression in the upper surface of the light scattering, translucent body;

a second light source located within the central depression; and the energization circuit being connected to energize the second light source.

8. A lantern as set forth in claim 7, further comprising:

the first and second light sources being super bright light emitting diodes.

9. Decorative illuminating apparatus comprising:

a translucent, light diffusing body having an upper surface; and a first light source disposed externally relative to the translucent, light diffusing body and located to cast light onto the upper surface to illuminate a portion of the translucent, light diffusing body, the first light source being located to be hidden from view to produce an impression with an observer that the translucent, light diffusing body is internally illuminated from a flame;

the translucent, light diffusing body supporting an imitation wick on the upper surface of the translucent, light scattering body;

a polished tip at the free end of the imitiation wick exhibiting specular reflection; and the first light source being positioned and oriented to illuminate from above both the translucent, light diffusing body and the polished tip of the imitation wick to create a bright spot from light reflected from the first light source to engender an impression on the part of an observer of an exposed flame extending from the translucent, light diffusing body.

10. Decorative illuminating apparatus as set forth in claim 9, further comprising:

a housing comprising a base supporting the translucent, light diffusing body;

a cap disposed over the translucent, light diffusing body in which the first light source is located; and a globe positioned between the base and the cap through which the translucent, light diffusing body is visible.

11. Decorative illuminating apparatus as set forth in claim 10, further comprising:

the first light source being located above the vertical extent of the globe and under and hidden within the cap as viewed from the side of the housing.

12. Decorative illuminating apparatus as set forth in claim 9, further comprising:

energization means for the first light source effective for causing the first light source to emit flickering light.

13. Decorative illuminating apparatus as set forth in claim 12, further comprising:

a second light source disposed within the translucent, light diffusing body.

14. Decorative illuminating apparatus as set forth in claim 13, further comprising:

energization means for the second light source effective for causing the second light source to emit flickering light.

15. Decorative illuminating apparatus as set forth in claim 12, further comprising:

the first light source being a super bright light emitting diode.

16. Decorative illuminating apparatus as set forth in claim 14, further comprising:

the first and second light sources being super bright light emitting diodes.

17. A decorative lantern comprising:

a housing having a base, a globe rising vertically from the base and a cap covering the globe;

a translucent, light scattering body disposed on the base of the housing enclosed within the globe through which the translucent, light scattering body is visible to an outside viewer, the translucent, light scattering body having an upper surface defined in part by a central depression;

an imitation wick extending upwardly from the central depression of the upper surface of the translucent, light scattering body, the imitation wick having a polished reflective tip visible extending above the translucent, light scattering body;

a super bright light emitting diode located within the cap where it is external to and above the central depression of the translucent, light scattering body and the imitation wick, the super bright light emitting diode being oriented to project light downwardly toward the upper surface of the translucent, light scattering body and the polished reflective tip to produce a glowing region in the translucent, light scattering body and a hot spot evocative of an open flame on the polished reflective tip; and an energization circuit for causing the super bright light emitting diode to luminesce with a flicker.

18. A decorative lantern as set forth in claim 17, further comprising:

a second super bright light emitting diode positioned within the translucent, light scattering body; and an energization circuit for causing the second super bright light emitting body to luminesce with a flicker.

* * * * *